US007646276B2

(12) United States Patent
Yang et al.

(10) Patent No.: US 7,646,276 B2
(45) Date of Patent: Jan. 12, 2010

(54) TRANSFORMER AND TRANSFORMER ASSEMBLY

(75) Inventors: Chao-Yuan Yang, Taipei Hsien (TW); Shun-Te Chang, Taipei Hsien (TW); Chang-Ching Yeh, Taipei Hsien (TW); Jui-Chia Chen, Taipei Hsien (TW)

(73) Assignee: Acbel Polytech Inc., Taipei Hsien (TW)

( * ) Notice: Subject to any disclaimer, the term of this patent is extended or adjusted under 35 U.S.C. 154(b) by 0 days.

(21) Appl. No.: 12/116,861

(22) Filed: May 7, 2008

(65) Prior Publication Data

US 2009/0045897 A1 Feb. 19, 2009

(30) Foreign Application Priority Data

Aug. 14, 2007 (TW) ..... 96129945 A

(51) Int. Cl.

| | |
|---|---|
| ***H01F 27/02*** | (2006.01) |
| ***H01F 27/06*** | (2006.01) |
| ***H01F 5/00*** | (2006.01) |
| ***H01F 27/30*** | (2006.01) |
| ***H01F 27/26*** | (2006.01) |
| ***H01F 17/04*** | (2006.01) |
| ***H01F 27/29*** | (2006.01) |

(52) U.S. Cl. ..... 336/83; 336/65; 336/200; 336/198; 336/210; 336/221; 336/192

(58) Field of Classification Search ..... None
See application file for complete search history.

(56) References Cited

U.S. PATENT DOCUMENTS

| | | | | |
|---|---|---|---|---|
| 3,076,165 | A * | 1/1963 | Weyrich | 439/83 |
| 5,165,056 | A * | 11/1992 | Chien-heng | 336/65 |
| 5,446,958 | A * | 9/1995 | Hoang | 29/605 |
| 6,483,412 | B1 * | 11/2002 | Holdahl et al. | 336/192 |
| 7,154,365 | B2 * | 12/2006 | Park | 336/198 |
| 7,456,717 | B2 * | 11/2008 | Grueso et al. | 336/192 |
| 2007/0057757 | A1 * | 3/2007 | Chen et al. | 336/212 |
| 2007/0075812 | A1 * | 4/2007 | Su et al. | 336/83 |
| 2007/0126542 | A1 * | 6/2007 | He et al. | 336/83 |
| 2007/0171022 | A1 * | 7/2007 | Marui et al. | 336/200 |
| 2008/0055033 | A1 * | 3/2008 | Cheng et al. | 336/83 |

* cited by examiner

*Primary Examiner*—Elvin G Enad
*Assistant Examiner*—Mangtin Lian
(74) *Attorney, Agent, or Firm*—patenttm.us

(57) ABSTRACT

The transformer has a bobbin, a coil assembly and a magnetic core assembly. The bobbin is mounted in the magnetic core assembly and has multiple connecting pins being formed on at least one side of a bottom surface of the bobbin. Each connecting pin has a top surface as a soldering surface that corresponds to a solder pad on a back of a circuit board. At least one fastener is further formed on the bottom surface of the circuit board. Therefore, when the transformer is mounted through the circuit board, the connecting pins are soldered on the back of the circuit board to reduce the total thickness of the combination of the transformer and the circuit board.

22 Claims, 8 Drawing Sheets

TRANSFORMER AND TRANSFORMER ASSEMBLY

BACKGROUND OF THE INVENTION

1. Field of the Invention

The present invention relates to a transformer and more particularly to a transformer that can be mounted to a circuit board to form a combination of the transformer and the circuit board with a thin thickness.

2. Description of the Related Art

Nowadays, electronic products have become much thinner and smaller, so the electronic elements for those electronic products have to be manufactured as small as possible. To satisfy the technical requirements, some integrated-circuit elements like transistors can be minimized by advanced semiconductor technologies. Passive circuit elements like resistors and capacitors can be made into smaller ones through advanced packaging technology or using some thinned substrate. However some elements are unable to be manufactured into smaller ones.

Taking a transformer as an example, the transformer converts electrical energy, transfers electrical energy from one circuit to another circuit and is often mounted on a circuit board. In order to provide enough voltage and current value, the turns of the windings of a transformer cannot be reduced. Therefore, the way to reduce the size is to modify the packaging structure. With reference to FIG. 7, as disclosed in Taiwan Utility Model Patent No. M290607, a conventional transformer (50) with multiple connecting pins for circuits connection is mounted on a circuit board (60). The transformer (50) comprises a bobbin (51), a magnetic core assembly (52) to which the bobbin (51) is coupled, and a base (53) on which the magnetic core assembly (52) is mounted. A coil assembly (511) is wound around the bobbin (51). A terminal seat (54) with multiple connecting pins extends from the lower edge of the bobbin (51). The connecting pins (541) protrude perpendicularly from the terminal seat (54) for electrically connecting to the ends of the coil assembly (511). When mounting the transformer (50) on the circuit board (60) to form a transformer assembly, the connecting pins (541) will be respectively inserted into soldering holes defined on the circuit board (60) and soldered. It is noted that the thickness of an electronic product having this transformer assembly will include the thickness of the transformer (50) and the circuit board (60), and reducing the size of this electronic product is difficult.

With reference to FIG. 8, as disclosed in Taiwan Utility Model Patent No. 512968 a bobbin (70) for a conventional surface-mounted (SMT) transformer is manufactured in a relatively flat shape. The bobbin (70) has a bottom. A coil assembly can be wound around the bobbin (70). Multiple flat connecting pins (71) transversely extend out from the opposite sides of the bottom and connect to the ends of the coil assembly. Each of the flat connecting pins (71) has a flat surface to be soldered on a solder pad of a circuit board. Because the bobbin (70) is a flat shape and can be attached to a circuit board by Surface Mounted Technology (SMT), the thickness of electronic product with the transformer can be reduced.

When either of the forgoing transformers is mounted on the circuit board, the entire thickness of the transformer assembly will inevitably include the thickness of the circuit board. Therefore electronic products using either one of the conventional transformer assembly are still thicker than desired.

To overcome the shortcomings, the present invention provides a transformer to mitigate or obviate the aforementioned problems.

SUMMARY OF THE INVENTION

The main objective of the invention is to provide a transformer that can be mounted on a circuit board to form a transformer assembly and to make an electronic product having the transformer assembly as thin as possible.

The transformer comprises a bobbin, a coil assembly and a magnetic core assembly.

The bobbin has a hollow winding core, an upper flange, a lower flange. The hollow winding core is flat-shaped and has an inner upper edge and an inner lower edge. The upper flange is formed on and protrudes transversely from the inner upper edge of the hollow winding core and has a top surface. The lower flange is formed on and protrudes transversely from the inner lower edge of the hollow winding core and has a bottom surface. Multiple connecting pins transversely protrude from at least one side of the lower flange of the bobbin. Each connecting pin has a top surface as a soldering surface.

The coil assembly is wound around the hollow winding core and has multiple coil ends corresponding and connecting to the connecting pins.

The magnetic core assembly has a base and a cover. The bobbin is coupled between the base and the cover. The connecting pins protrude out from the magnetic core assembly.

When the transformer is mounted on a circuit board to form a transformer assembly, the circuit board has a through hole corresponding to the position for where the transformer is going to be mounted. When the transformer is upwardly moved into the through hole of the circuit board, the connecting pins are able to be soldered on the solder pads on the back of the circuit board with their soldering surfaces. Because the transformer is mounted through and soldered on the circuit board, the total thickness of this transformer assembly will not include the thickness of the circuit board. Therefore it will help to reduce the thickness of an electronic product having this transformer assembly.

Another objective of the invention is to provide a transformer that has high fastening strength when being mounted on a circuit board. The approach is to form at least one fastener at another side of the lower flange opposite to the connecting pins. When the transformer being mounted on the circuit board, the at least one fastener can attach to the circuit board to enhance the fastening strength between the transformer and the circuit board.

The fastener can be an engaging element having a slot inwardly formed on the engaging element. The through hole of the circuit board has an inner edge to be held in the slot transversely.

Furthermore, the fastener can be implemented as stubs or rivets. The circuit board may have multiple fastener holes correspond to the stubs or rivets. The stubs or rivets may respectively insert into the fastener holes when the transformer passes through the through hole under the circuit board.

Other objectives, advantages and novel features of the invention will become more apparent from the following detailed description when taken in conjunction with the accompanying drawings.

DETAILED DESCRIPTION OF THE PREFERRED EMBODIMENTS

A transformer assembly in accordance with the present invention comprises a transformer (10, 10*a*, 10*b*) mounted on a circuit board (40).

Figure 1:
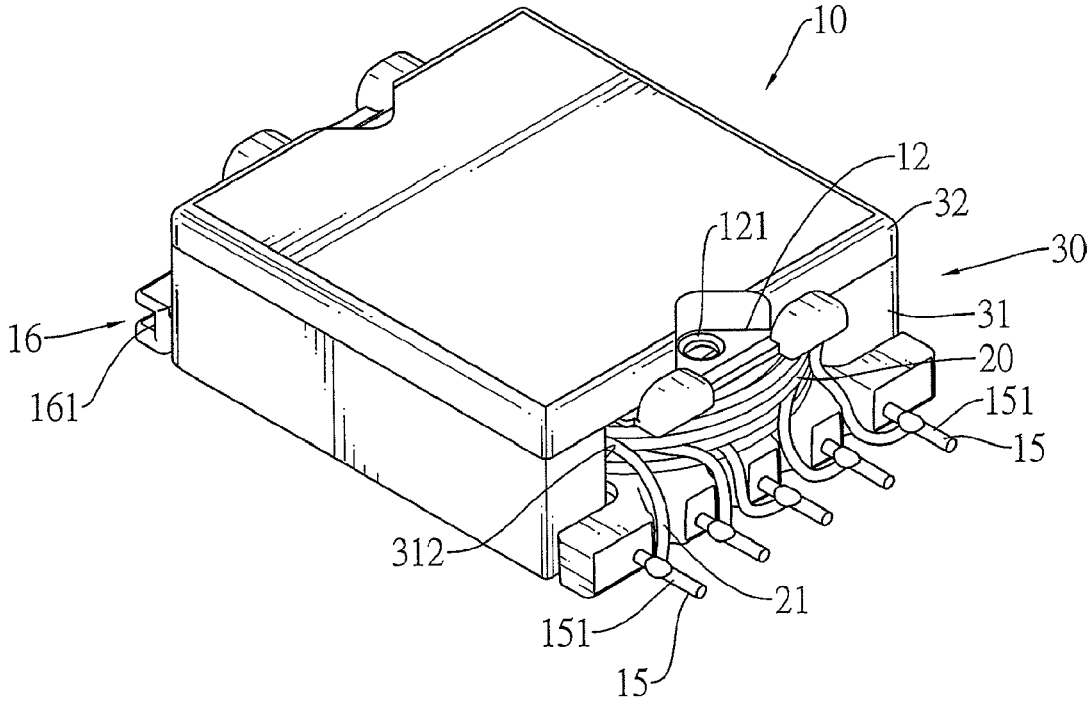
FIG. 1 is a perspective view of a first embodiment of a transformer in accordance with the present invention.
Figure 2:
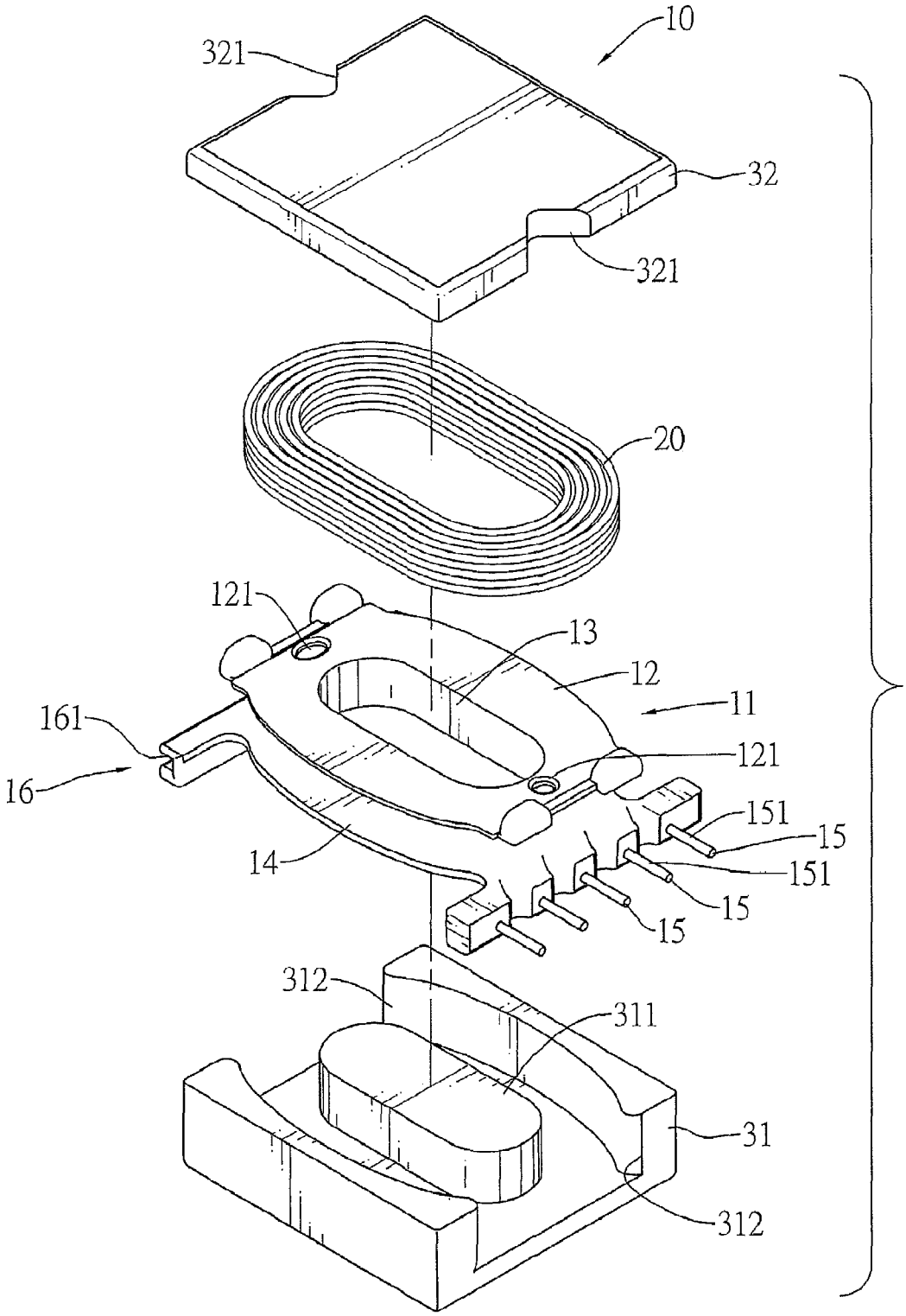
FIG. 2 is an exploded perspective view of the transformer in FIG. 1.

With reference to FIGS. 1 and 2, a first embodiment of the transformer (10) in accordance with the present invention comprises a bobbin (11), a coil assembly (20) and a magnetic core assembly (30).

The bobbin (11) comprises a hollow winding core (13), an upper flange (12) and a lower flange (14). The hollow winding core (13) is flat-shaped and has an inner upper edge and an inner lower edge. The upper flange (12) is formed on and protrudes transversely from the inner upper edge of the hollow winding core (13), and has a top surface with at least one lead hole (121). In this embodiment, two lead holes (121) are formed through the upper flange (12) and are opposite to each other. The lower flange (14) is formed on and protrudes transversely from the inner lower edge of the hollow winding core (13) and has a bottom surface. Multiple connecting pins (15) transversely protrude from at least one side of the lower flange (14). Each connecting pin (15) has a top surface as a soldering surface (151).

In this embodiment, a fastener is further formed at one side of the lower flange (14) opposite to the connecting pins (15). The fastener can be an engaging element (16) with a slot (161) inwardly formed on the engaging element (16).

Figure 3:
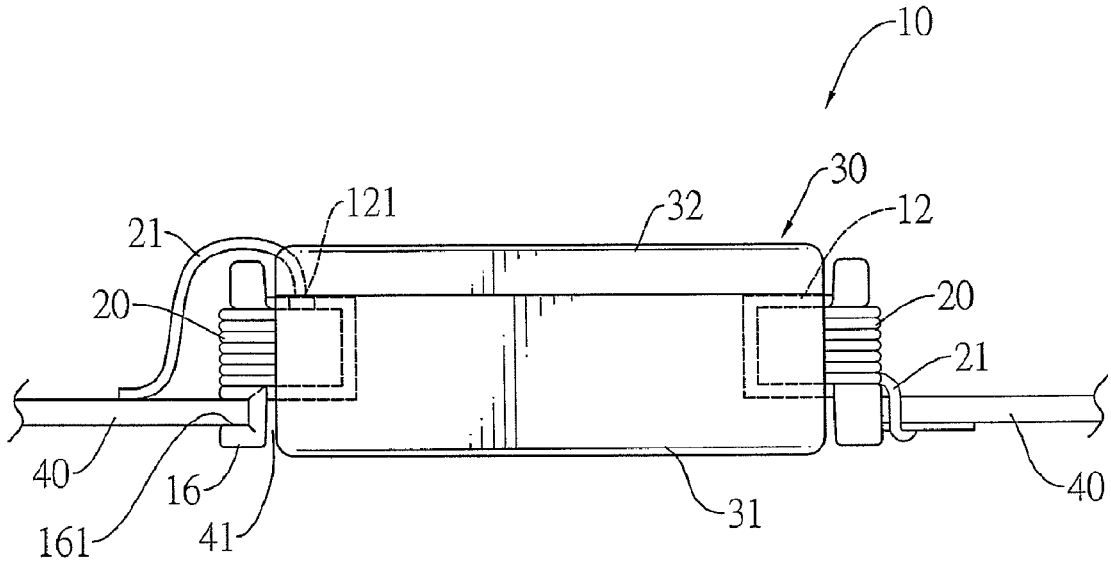
FIG. 3 is a side view in partial section of a first embodiment of a transformer assembly in accordance with the present invention.

The coil assembly (20) is wound around the hollow winding core (13) of the bobbin (11) and has multiple coil ends (21). Some of the coil ends (21) correspond to and connect to the connecting pins (15). With reference to FIG. 3, the rest of the coil ends (21) that are not connected to the connecting pins (15) may pass through the lead holes (121) of the upper flange (12) of the bobbin (11).

The magnetic core assembly (30) has a base (31) and a cover (32). The bobbin (11) is coupled between the base (31) and the cover (32). The connecting pins (15) of the bobbin (11) protrude out from the magnetic core assembly (30). In this embodiment, the base (31) has a central core (311) and two openings (312) formed on opposite sides of the base (31). The central core (311) corresponds to and extends through the hollow winding core (13) of the bobbin (11). The two openings (312) respectively correspond to the engaging element (16) and the connecting pins (15) so that the engaging element (16) and the connecting pins (15) can protrude outward from the magnetic core assembly (30). The cover (32) further has two notches (321) corresponding to the lead holes (121) of the bobbin (11).

Figure 5:
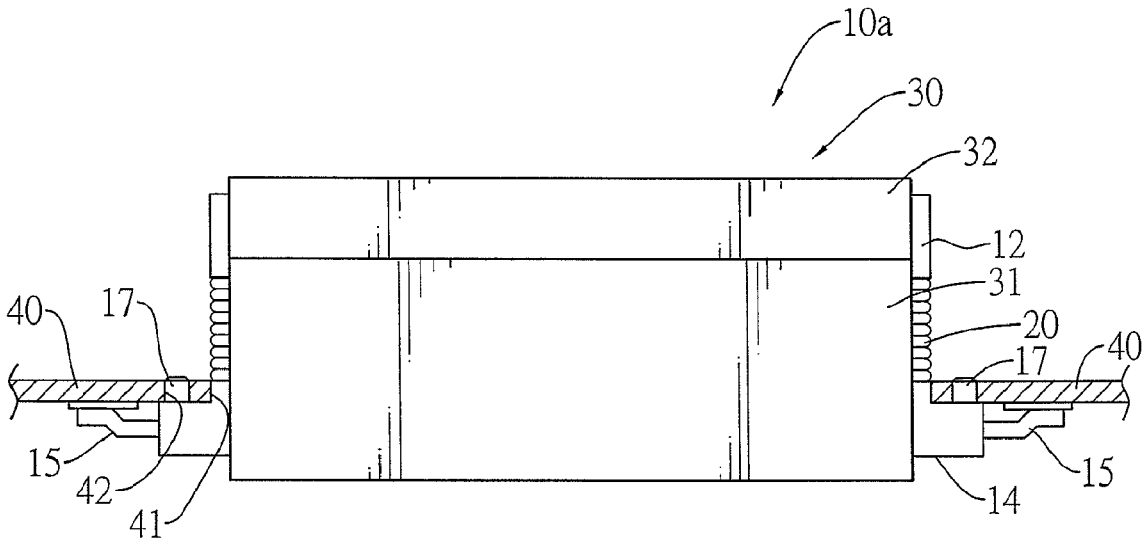
FIG. 5 is a side view in partial section of a second embodiment the transformer assembly in accordance with the present invention.

With reference to FIGS. 3 and 5, the circuit board (40) is defined with a through hole (41) and multiple fastener holes (42). The through hole (41) is formed through the circuit board (40) and has an edge. The fastener holes (42) are formed through the circuit board (40) and are adjacent to the through hole (41).

Figure 4:
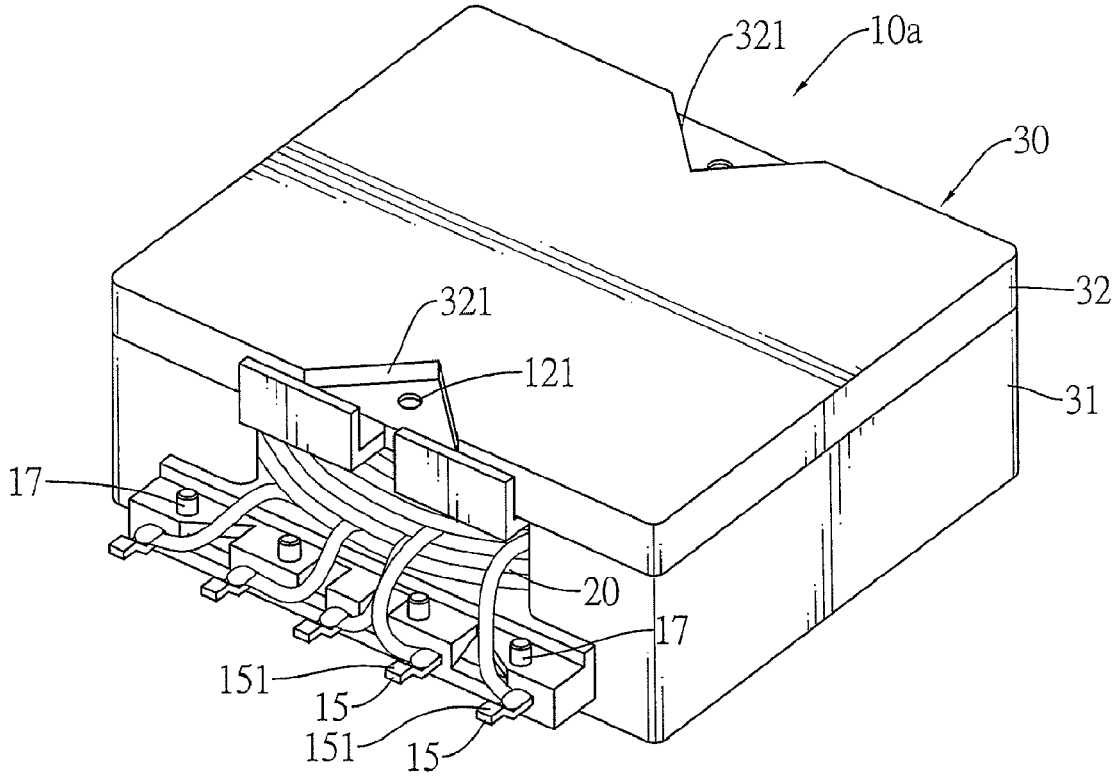
FIG. 4 is a perspective view of a second embodiment of the transformer in accordance with the present invention.

With reference to FIGS. 4 and 5, a second embodiment of the transformer (10*a*) has multiple connecting pins (15) being formed on opposite sides of the lower flange (14) of the bobbin (11). In this second embodiment, the lower flange (14) further has multiple fasteners being formed on the upper surfaces of the opposite sides of the lower flange (14). The fasteners can be implemented as multiple stubs (17) that respectively correspond to and be inserted into the fastener holes (42) of the circuit board (40).

Figure 6:
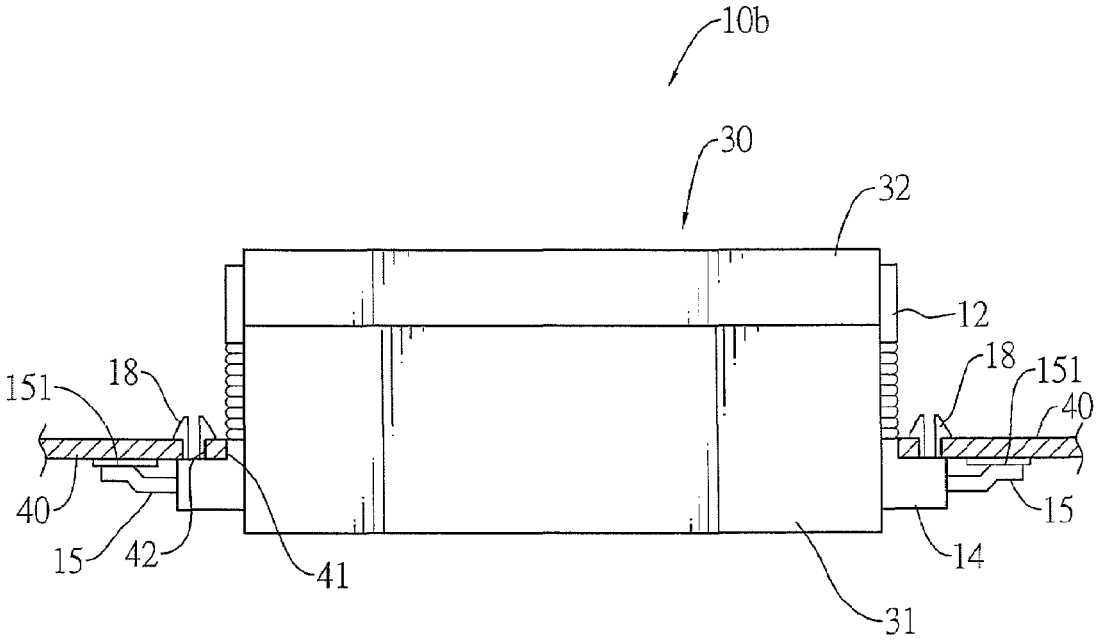
FIG. 6 is a side view in partial section of a third embodiment of the transformer assembly in accordance with the present invention.
Figure 7:
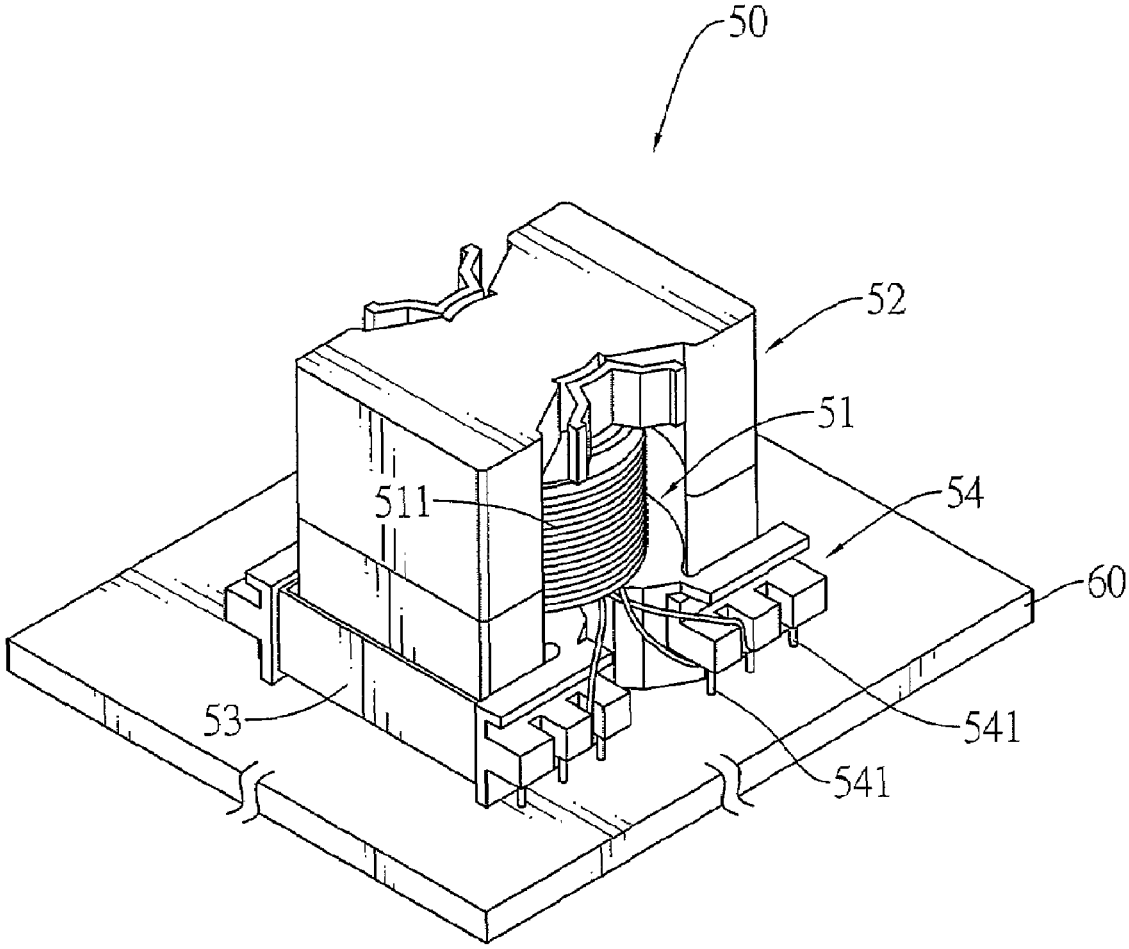
FIG.7 PRIOR ART
FIG. 7 is a perspective view of a conventional transformer mounted on a circuit board in accordance with the prior art.
Figure 8:
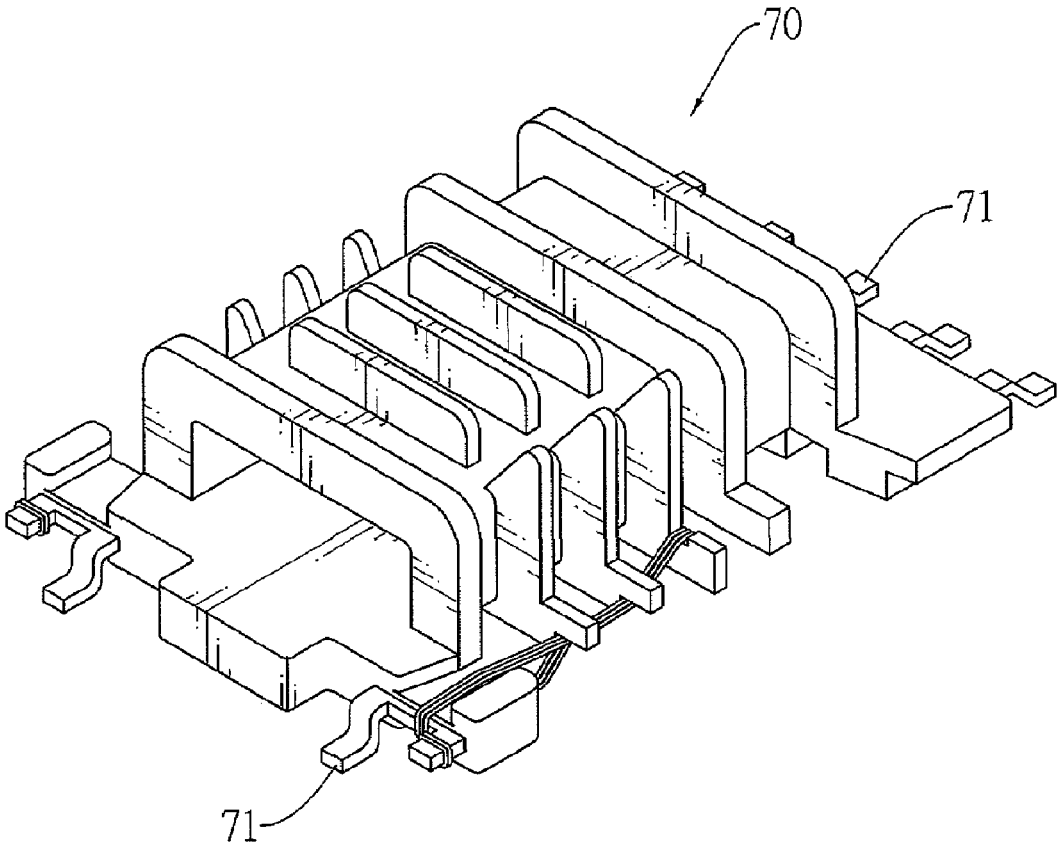
FIG.8 PRIOR ART
FIG. 8 is a perspective view of a bobbin of a conventional transformer in accordance with the prior art.

With further reference with FIG. 6, a third embodiment of the transformer (10*b*) has multiple fasteners being implemented as rivets (18) that can be respectively inserted into the fastener holes (42) and steadily abut against the upper surface of the circuit board (40).

With further references to FIGS. 3, 5, and 6, when mounting the transformer (10, 10*a*, 10*b*) on the circuit board (40), the transformer (10, 10*a*, 10*b*) is upwardly moved into the through hole (41) of the circuit board (40) until the soldering surfaces (151) of the connecting pins (15) respectively touch the solder pads on the back of the circuit board (40). The connecting pins (15) are then respectively and electrically soldered on the solder pads. Taking the first embodiment as an example, the transformer (10) has the engaging element (16) with the slot (161). When mounting the transformer (10) to the circuit board (40), the transformer (10) inclines with an angle in order to easily pass through the through hole (41) of the circuit board (40). The edge of the through hole (41) is then held in the slot (161) of the engaging element (16), and the soldering surfaces (151) of the connecting pins (15) and the solder pads of the circuit board (40) are soldered together.

In the second or third embodiment, the fasteners of the transformer (10*a*, 10*b*) are stubs (17) or rivets (18). When mounting the transformer (10*a*, 10*b*) to the circuit board (40), the transformer (10*a*, 10*b*) passes through the through hole (41) and the stubs (17) or rivets (18) are respectively inserted into the fastener holes (42). The connecting pins (15) with their solder surfaces (151) soldered to the solder pads of the circuit board (40). The foregoing engaging element (16), stubs (17) and rivets (18) can enhance the engaging strength between the transformer (10, 10*a*, 10*b*) and the circuit board (40) to make up for a deficiency of soldering. Further, these fasteners in different embodiments can also be used as positioning elements in soldering processes to reduce the defective rate and the usage of other auxiliary soldering apparatus.

Since the transformer in accordance with the present invention is mounted through and soldered on the circuit board, the total thickness of this transformer assembly will not include the thickness of the circuit board. There is no need for using an isolation base to isolate the circuit board and the magnetic core assembly. Thus an electronic product having this transformer assembly can be thinner. Furthermore, with the lead holes on the upper flange of the transformer, multiple types of the coils can be applied in the bobbin of the transformer. In other words, distal ends of some coils that are not connected to the connecting pins can extend through the lead holes and be directly soldered on the circuit board.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A transformer comprising a bobbin comprising a top surface, a bottom surface, multiple parallel connecting pins being transversely formed on at least one side of the bottom surface, and at least one fastener being formed on at least one side of the bottom surface and adapted to engage with a circuit board so that the bobbin is directly engaged with the circuit board;

a coil assembly being wound around the bobbin and having multiple coil ends corresponding and connecting to the connecting pins; and a magnetic core assembly comprising a base and a cover, wherein the bobbin is coupled between the base and the cover and the connecting pins protrude from the magnetic core assembly and the base is in part adapted to sink into a through hole of the circuit board.

2. The transformer as claimed in claim 1, wherein the at least one fastener is an engaging element having a slot inwardly formed on the engaging element.

3. The transformer as claimed in claim 1, wherein the at least one fastener is a stub being formed on one side of the bottom surface of the bobbin.

4. The transformer as claimed in claim 1, wherein the at least one fastener is a rivet being formed on one side of the bottom surface of the bobbin.

5. The transformer as claimed in claim 1, wherein the bobbin has multiple fasteners being formed on two opposite sides of the bottom surface of the bobbin; and the fasteners are multiple stubs.

6. The transformer as claimed in claim 1, wherein the bobbin has multiple fasteners being formed on two opposite sides of the bottom surface of the bobbin; and the fasteners are multiple rivets.

7. The transformer as claimed in claim 1, wherein the base of the magnetic core assembly has a central core corresponding to and extending through the bobbin, and two openings being formed on two opposite sides of the base, whereby the connecting pins protrude outward from the two openings.

8. The transformer as claimed in claim 1, wherein at least one lead hole is formed through the top surface of the bobbin to allow a part of the coil ends passing through.

9. The transformer as claimed in claim 7, wherein at least one lead hole is formed through the top surface of the bobbin to allow a part of the coil ends passing through.

10. The transformer as claimed in claim 8, wherein the cover of the magnetic core assembly further has at least one notch corresponding to the at least one lead hole of the bobbin, whereby the at least one lead hole is exposed from the cover.

11. The transformer as claimed in claim 9, wherein the cover of the magnetic core assembly further has at least one notch corresponding to the at least one lead hole of the bobbin, whereby the at least one lead hole is exposed from the cover.

12. A transformer assembly comprising a circuit board having a back surface and a through hole;

a bobbin having a top surface, a bottom surface, at least one fastener being formed on at least one side of the bottom surface and engaged with the circuit board, and multiple parallel connecting pins being formed on at least one side of the bottom surface and soldered on the back surface of the circuit board;

a coil assembly being wound around the bobbin and having multiple coil ends corresponding and connecting to the connecting pins; and a magnetic core assembly partly passing through the through hole of the circuit board and having a base and a cover, wherein the bobbin is coupled between the base and the cover and the connecting pins are exposed.

13. The transformer assembly as claimed in claim 12, wherein the at least one fastener is an engaging element having a slot inwardly formed on the engaging element.

14. The transformer assembly as claimed in claim 12, wherein the at least one fastener is a stub being formed on one side of the bottom of the bobbin;

the circuit board has a fastener hole corresponding to the stub; and the stub is inserted into the fastener hole.

15. The transformer assembly as claimed in claim 12, wherein the at least one fastener is a rivet being mounted on one side of the bottom surface of the bobbin;

the circuit board has a fastener hole corresponding to the rivet; and the rivet is inserted into the fastener hole and hook the upper surface of the circuit board.

16. The transformer assembly as claimed in claim 12, wherein the bobbin has multiple fasteners being formed on two opposite sides of the bottom surface of the bobbin;

the fasteners are multiple stubs;

the circuit board has multiple fastener holes respectively corresponding to the stubs; and the stubs are respectively inserted into the fastener holes.

17. The transformer assembly as claimed in claim 12, wherein the bobbin has multiple fasteners being formed on two opposite sides of the bottom surface of the bobbin;

the fasteners are multiple rivets;

the circuit board has multiple fastener holes respectively corresponding to the rivets; and the rivets are respectively inserted into the fastener holes and hook the upper surface of the circuit board.

18. The transformer assembly as claimed in claim 12, wherein the base of the magnetic core assembly has a central core corresponding to and extending through the bobbin and two openings being formed on two opposite sides of the base, whereby the connecting pins protrude outward from the two openings.

19. The transformer assembly as claimed in claim 12, wherein at least one lead hole is formed through the top surface of the bobbin to allow a part of the coil ends passing through.

20. The transformer assembly as claimed in claim 18, wherein at least one lead hole is formed through the top surface of the bobbin to allow a part of the coil ends passing through.

21. The transformer assembly as claimed in claim 19, wherein the cover of the magnetic core assembly further has at least one notch corresponding to the at least one lead hole of the bobbin, whereby the at least one lead hole is exposed from the cover.

22. The transformer assembly as claimed in claim 20, wherein the cover of the magnetic core assembly further has at least one notch corresponding to the at least one lead hole of the bobbin, whereby the at least one lead hole is exposed from the cover.

* * * * *